United States Patent [19]

Hertrampf

[11] Patent Number: 4,982,855

[45] Date of Patent: Jan. 8, 1991

[54] SCREW CLOSURE FOR A BOTTLE

[76] Inventor: Michael Hertrampf, Schafereiweg 7, D-3007 Gehrden 1, Fed. Rep. of Germany

[21] Appl. No.: 272,695

[22] PCT Filed: Jan. 15, 1988

[86] PCT No.: PCT/EP88/00026

§ 371 Date: Nov. 9, 1988

§ 102(e) Date: Nov. 9, 1988

[87] PCT Pub. No.: WO88/06129

PCT Pub. Date: Aug. 25, 1988

[51] Int. Cl.[5] ..... B65D 47/20

[52] U.S. Cl. ..... 215/235; 215/363

[58] Field of Search ..... 215/235, 236, 363, 329

[56] References Cited

U.S. PATENT DOCUMENTS

| | | | |
|---|---|---|---|
| 134,586 | 1/1873 | Bradley | 215/235 |
| 320,364 | 6/1885 | Kennedy | 215/363 X |
| 635,398 | 10/1899 | Schroeder | 215/329 |
| 837,779 | 12/1906 | Bills | 215/235 |
| 870,243 | 11/1907 | Morehouse | 215/235 |
| 1,087,303 | 2/1914 | Lamb | 215/363 X |
| 1,363,983 | 12/1920 | Knudsen | 215/235 |
| 1,723,799 | 8/1929 | McDougall | 215/235 |
| 2,950,833 | 8/1960 | Short | 215/235 |
| 4,441,637 | 4/1984 | Libit | 215/235 X |

FOREIGN PATENT DOCUMENTS

| | | | |
|---|---|---|---|
| 6403 | of 1885 | United Kingdom | 215/235 |
| 1014 | of 1910 | United Kingdom | 215/329 |

*Primary Examiner*—Stephen Marcus
*Assistant Examiner*—Nova Stucker
*Attorney, Agent, or Firm*—Allegretti & Witcoff, Ltd.

[57] ABSTRACT

The invention relates to a closure cap for a bottle or like containers, having an internally-threaded cylindrical part for screwing onto an externally threaded bottleneck, and with a sealing member, separate from the cylindrical part and connected to the cylindrical part, being provided with an annular sealing surface to abut upon the mouth of the bottleneck. The sealing member pivots around a rotational axis which is located in a plane perpendicular to the axis of the cylindrical part, and located radially inwards of the annular sealing surface. By unscrewing the screw-type closure cap, the disc-like sealing member tilts, thus allowing the contents of the bottle to be poured out without the screw-type closure cap being completely screwed off. Thus, the cap is prevented from falling down and being soiled, or from getting lost. By opening the screw-type closure cap to different extent, it is, moreover, possible to adjust the cross-section for the outflow and, thus, to control the quantity delivered.

17 Claims, 7 Drawing Sheets

SCREW CLOSURE FOR A BOTTLE

The invention relates to a closure cap for a bottle or like container.

PRIOR ART

Known screw-type closures for bottles are essentially shaped like caps. The cylindrical part of the cap is provided with internal threads by which the cap may be screwed on external threads of a bottleneck. The bottom of the closure cap consists of a disc-like sealing member which tightly abuts upon the upper edge of the bottleneck when the screw-type closure cap is tightened. To open a bottle closed with such a screw-type closure cap, it is required to completely unscrew the cap. Thus, it may fall on the dirty ground, or it may even become lost. Moreover, it is an effort to screw the closure cap on the bottle again after use.

As a matter of fact, for beer bottles, snap-on closure caps are known which are undetachably fixed to the bottleneck, but they are very costly. Furthermore, they cause difficulties in cleaning as they are permanently fixed to the bottle.

DE-OS No. 14 32 188 dislcoses a screw-type closure cap having a friction cork, which is separate from the screw-type closure cap, the friction cork being connected by friction and form to the screw-type closure cap. Thus, the friction cork is nothing more than a special form of sealing which is unmovably connected to the screw-type closure cap. Consequently, this known screw-type closure cap has the same disadvantages as screw-type closure caps mentioned above.

U.S. Pat. No. 2,950,833 disclose a screw-type closure cap, the bottom of which consists of two disc halves which are hinged to a common diametrical axis. The flaps thus formed, loosely rest upon the upper end of a cylindrical cap. When emptying the container, the flaps fold up. A tight closure is not possible with such a screw-type closure cap.

THE INVENTION

It is the object of the invention to provide for a bottle or like containers a screw-type closure cap of the type described which eliminates the risk of falling off the bottle and, thus, of being soiled or getting lost, and which should, moreover, be cheap to make.

The screw-type closure cap constructed according to the invention permits pouring the contents out of the bottle by slightly loosening the screw-type closure cap. When the closure cap is slightly loosened and the bottle is tilted to a horizontal position, a disc-like sealing member in the cap rotates about its axis due to the pressure of the liquid in the bottle, and the loading on such sealing member. The portion of the sealing member which is below the rotational axis, moves outwardly so that liquid may flow out, while the portion of the sealing member above the rotational axis, simultaneously moves slightly inwardly so that air may enter the interior of the bottle, so that no counter pressure is produced which might impede the flow. Thus, the bottle may be emptied without removing the screw-type closure cap; it is sufficient to loosen the screw-type closure cap slightly. The cap cannot fall down, become soiled or get lost. Moreover, it is not necessary to screw on the cap completely to close the bottle since the cap always remains partially screwed on the external thread of the bottleneck. For complete closing, it is necessary to turn the screw-type closure cap in the closing direction, whereby an annular sealing surface on the sealing member tightly abuts against the upper end of the bottleneck, particularly in the area of its inner radial edge.

Due to the geometry of the closure cap, the tilting movement of the disc-like sealing member depends on the orientation of the disc axis which changes with the rotary position of the internally-threaded cylindrical portion of the cap. Consequently, the cross-section of the opening may be adjusted by varying the rotary position of the cylindrical part. This in turn permits regulating the flow of liquid.

The rotational axis of the disc-like sealing member may fall on the axis of the cylindrical cap, i.e., across the diameter of the cylinder, so that with the tilting of the disc-like sealing member, the flow-out cross-section is approximately equal to the cross-section for entering air. But it is also possible to position the rotational axis of the disc-like sealing member offset from the axis of the cylindrical cap, in order to achieve an unequal relation between the flow-out and entering cross-sectional areas which may be advantageous for certain types of liquids.

Preferably, the disc-like sealing member should be slightly larger than the inside aperture of the bottleneck. This allows relatively large tilting movements of the disc-like sealing member with relatively slight turning of the cylindrical cap in the opening direction. A maximum aperture is ensured long before the internal thread of the cylindrical cap becomes free from the external thread of the bottleneck, and before the cap is completely detached from the bottle as in known screw-type closure caps. In any case, the closure cap constructed according to the invention may be completely screwed off at any time, like the prior art closure caps. For this reason, it may be screwed onto other bottles and re-used as often as desired.

In its closed position, the disc-shaped sealing member fits snugly against the inside aperture of the cylindrical cap while freely movable. Thus, there is no access to the interior of the bottle, e.g., for insects, when the screw-type closure cap is open and the bottle is in an upright position.

In one form of the invention, axial clearance is provide between the disc-like sealing member and the cylindrical part of the cap so that in the closed position, the top of the bottleneck slightly protrudes beyond the cylindrical part, thus substantially avoiding liquid contact with the cylindrical part when the cap is opened.

Preferably, the rotational axis of the disc-like sealing member is positioned outside the sealing member, i.e., on the side opposite its sealing side. Thus, the weight of the disc-shaped part contributes to opening it. It is also possible to make the disc-like member particularly heavy or to provide it with some weights for increasing this effect.

The parts of the screw-type closure cap according to the invention may be made of plastic, e.g., by injecting molding. For example, the rotational axis may be integrally molded as a shaft with the cylindrical cap. The disc-like sealing member is molded with C-shaped bearing brackets which simply snap onto the shaft. Circumferential rings or projections are integrally molded on the shaft between the C-shaped bearings to center the disc-like sealing member so that it may freely swing around its axis without any hindrance.

If the disc-like sealing member is made of resilient plastic, its peripheral edge may directly serve as a sealing surface or the edge may be coated with an even softer plastic material as known in the art. It is also suitable to provide the disc-like sealing member with a peripheral groove, notch or the like, onto which an O-ring with a higher elasticity is inserted, thus always guaranteeing safe sealing even in case of wide manufacturing tolerances, or when the disc-like sealing member has become deformed.

Preferably, the cylindrical part of the cap has a circular convex sealing bead protruding inwardly from its lower open end, for the purpose of tight contact with the cylindrical external surface of the bottleneck. This prevents liquid which has penetrated into the thread area from trickling down when the bottle is in an upright position.

In another embodiment of the invention the disc-like sealing member is provided on the inside, preferably in the central area, with a protrusion, such as a pin. The latter may be dimensioned in such a way that, when opening the screw-type closure cap, the tilting movement of the disc-like sealing member is stopped when the pin abuts the interior wall of the bottleneck. This eliminates the possibility of the disc-like sealing member getting jammed when the screw-type closure cap is closed. Furthermore, the protrusion contributes to dislocating the gravity center of the disc-like sealing member away from its rotational axis, so that the tilting force is increased when the closure cap is opened. The protrusion also tends to tilt the disc-like sealing member into a horizontal position even in the opened position when the bottle is upright, thereby closing the opening to prevent the penetration by insects.

THE DRAWINGS

The invention will be explained in more detail in conjunction with the drawings in which FIG. 1 represents a perspective view of an embodiment of a screw-type closure cap in accordance with the invention, screwed on a bottle in upright position, showing its neck only;

DETAILED DESCRIPTION

Figure 1:
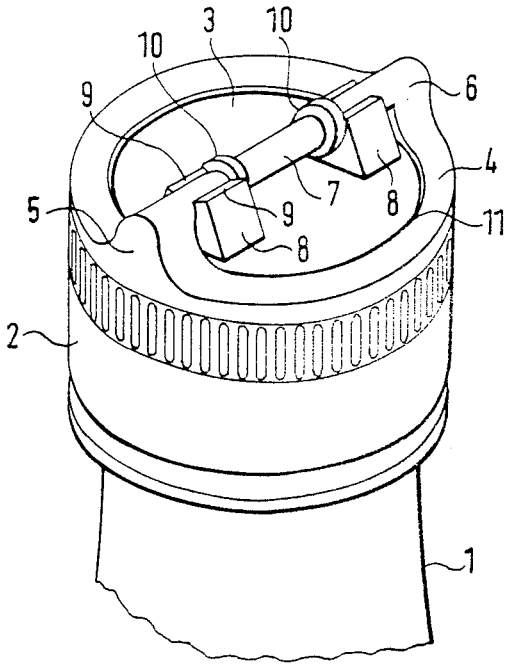
Figure 2:
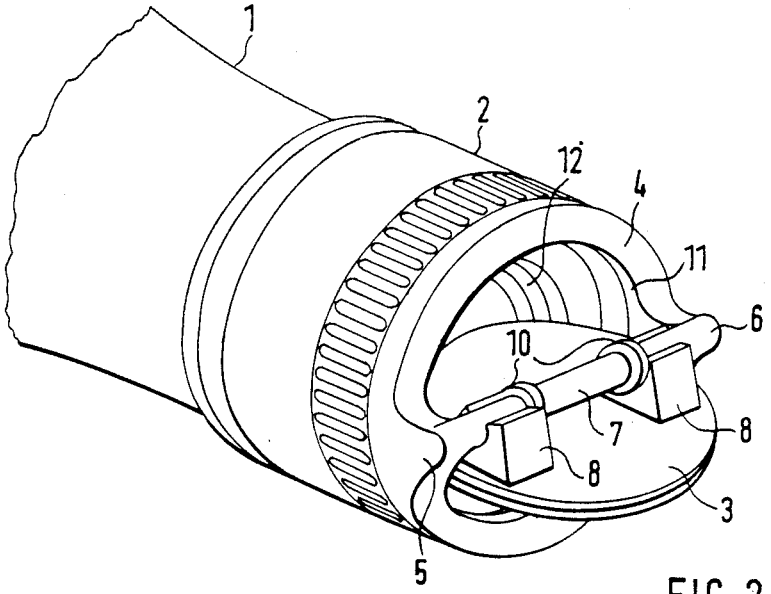
FIG. 2 shows the closure cap of FIG. 1 in the tilted and pouring position.

FIGS. 1 and 2 show a screw-type closure cap with a cylindrical part 2 and a disc-like sealing member 3, screwed on a partially illustrated externally threaded bottleneck 1. In the area of the top edge 4, the cylindrical part 2 is provided with a pair of small spaced brackets 5 and 6, lying on the diameter of the cap. A bar or rod 7 is integrally formed with the brackets. The bar extends between the brackets and serves as a rotational axis for the disc-like sealing member 3. The disc-like sealing member 3 is provided with C-shaped bearing brackets 8, the arms 9 of which are snapped around the bar 7, so that the disc-like sealing member 3 may swing freely around the bar 7 as a rotational axis. The free distance between the arms 9 is slightly smaller than the diameter of the bar 7, so that they may be elastically snapped around the bar 7. The bar 7 is provided with integral flanges 10 which abut against the interior sides of the small bearing brackets 8, with a slight clearance. Thus, the disc 3 may swing freely within the interior periphery 11 of the cylindrical part 2.

Figure 3:
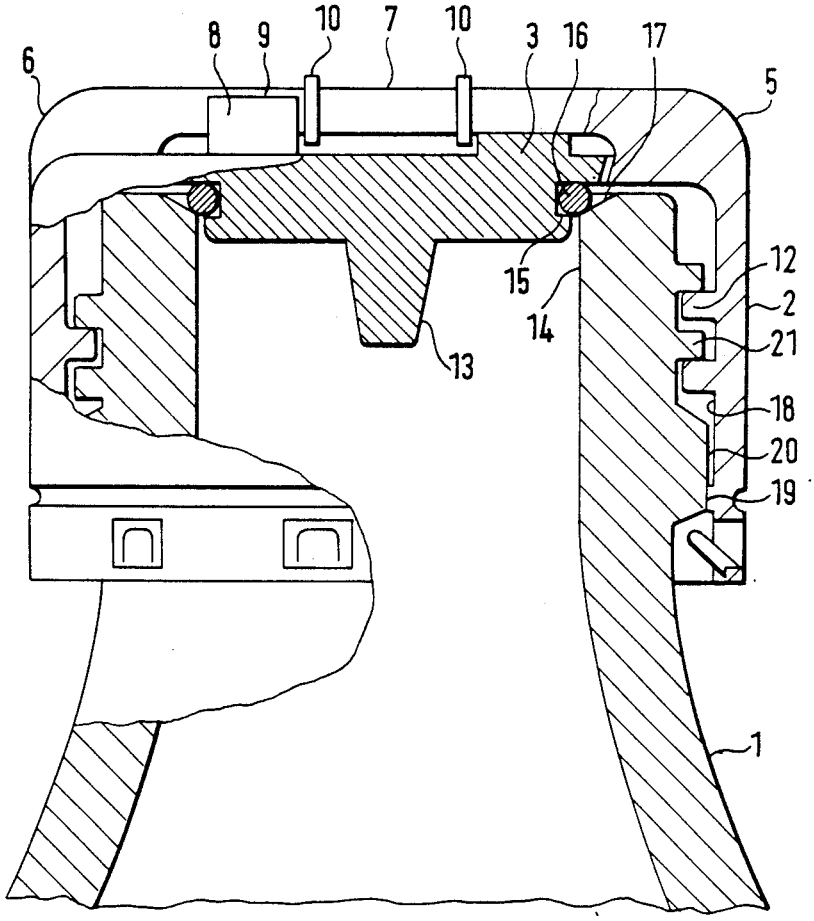
FIG. 3 is an enlarged partial cross-section through the screw-type closure cap of FIG. 1.

As shown in FIGS. 2 and 3, the interior of the cylindrical part 2 of the cap is provided with internal threads 12 at the upper end of the bottleneck 1. In FIG. 1 the screw-type closure cap is completely screwed on, and the bottle closed. The disc-like sealing member is compressed against the internal seat 17 of the bottle neck. In FIG. 2 the screw-type closure cap is shown slightly unscrewed in open position and the bottle tilted, so that the disc-like sealing member 3, due to its weight, has turned downwards around the nearly horizontally positioned bar 7. Thus, liquid may flow out below the disc-like sealing member 3, and air flows into the bottle above said sealing member. This ensures a very safe and uniform pouring of liquid.

As soon as the bottle with the loosened closure cap, FIG. 2, is put into an upright position again, the disc-like sealing member 3 falls back into its horizontal position without tightly closing the bottle. Nevertheless, the aperture of the screw-type closure cap is closed to an extent that e.g., insects cannot get into the bottle. In addition, evaporation of the liquid is impeded even in this unscrewed position.

Figure 4:
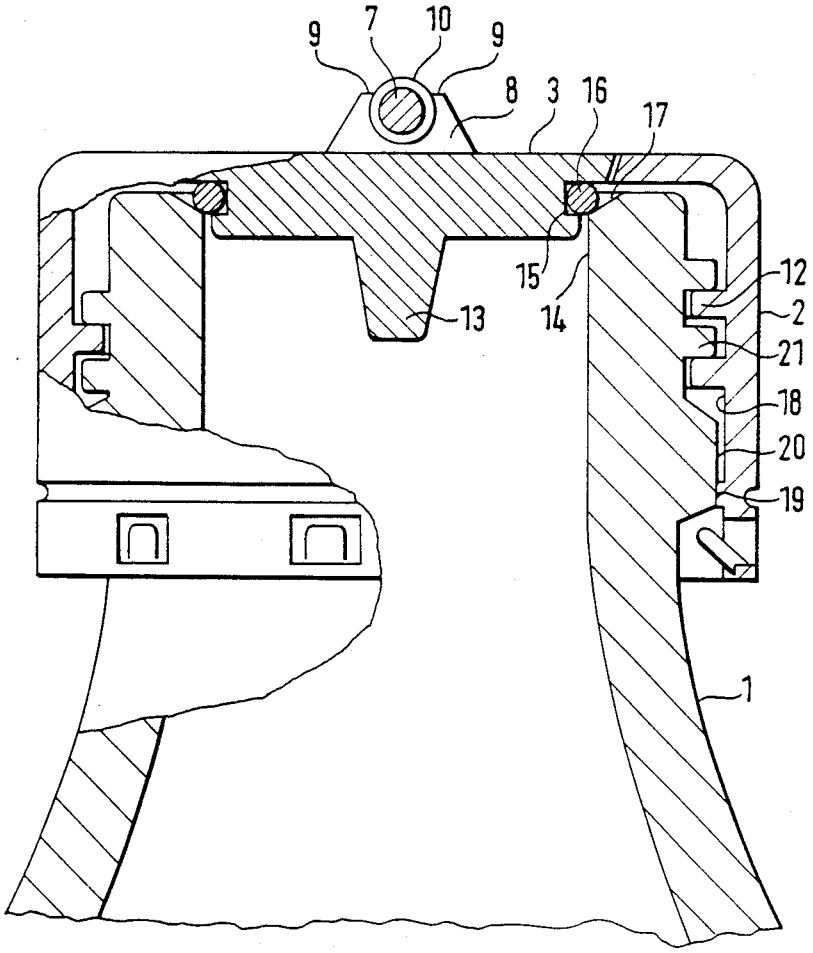
FIG. 4 is a cross-sectional view perpendicular to the plane of projection, of the closure cap shown in FIG. 3.

Referring to FIGS. 3 and 4, the disc-shaped part 3 is provided at its interior sealing side with a pin 13 long enough so that it strikes the interior wall 14 of the bottleneck 1 when the disc-like sealing member 3 is in open position, and thus limits the tilting of the disc-like sealing member 3 in the opening direction. Furthermore, the pin 13 contributes by its weight to dislocating the gravity center of the disc-like sealing member 3 away from the rotational axis of the bar 7, thereby facilitating opening and closing of the disc-like sealing member 3 when the bottle is tilted and turned upright.

The peripheral edge of the disc-like sealing member 3 is provided with a groove into which an O-ring 16 is inserted. The ring sits on the internal conical sealing surface or seat 17 at the upper end of the bottleneck 1.

The interior surface 18 of the cylindrical part 2 of the cap is provided at its lower end with a small circular bead 19 which, due to the circumferential elasticity of the cylindrical wall, abuts against the exterior surface 20 of the bottleneck 1. This seal prevents liquid which might have accumulated in the internal thread area of the bottleneck, from trickling down when the bottle is upright.

Figure 5:
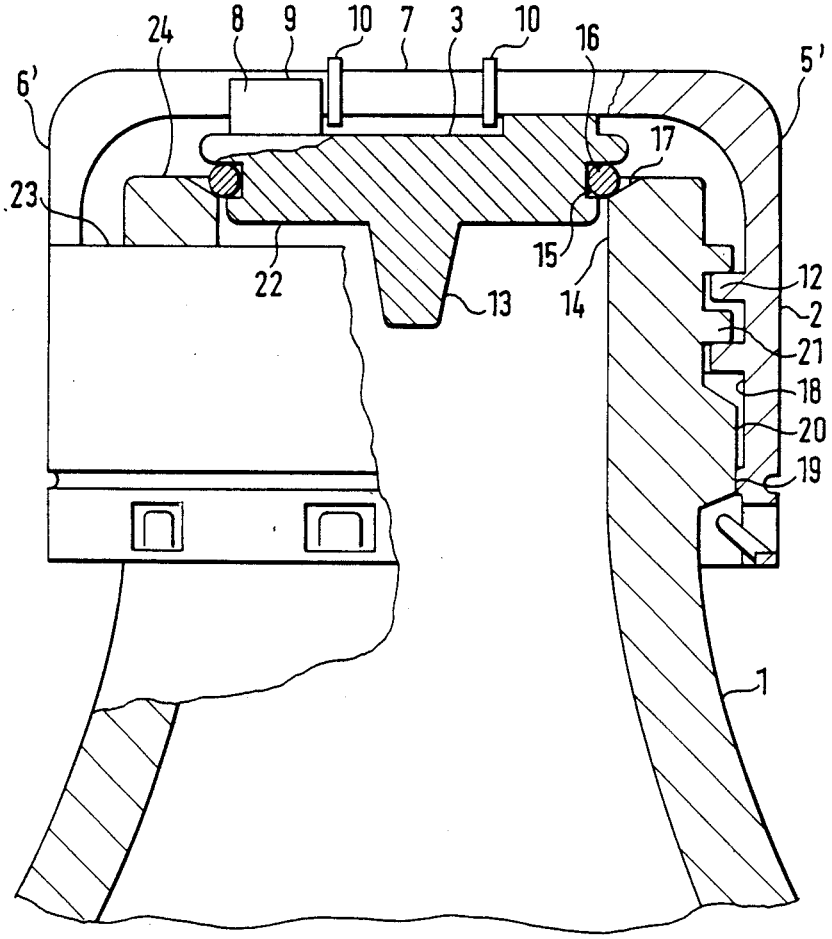
FIG. 5 is a view similar to FIG. 3 of a modification of the invention.
Figure 6:
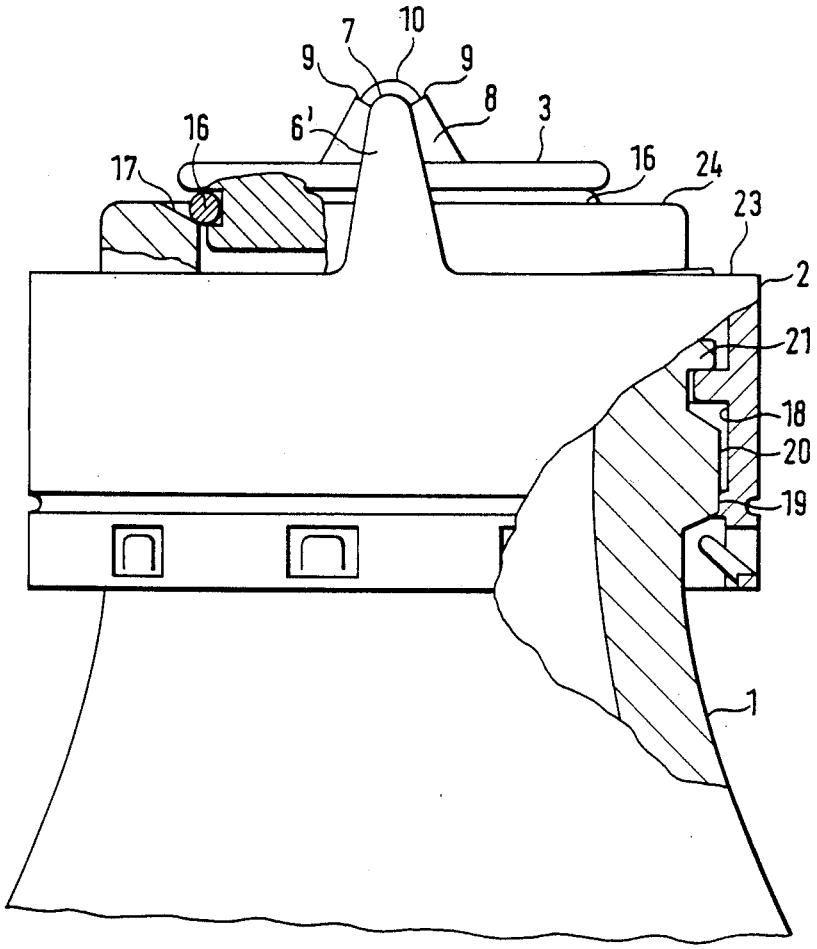
FIG. 6 is a side view partly in section of the closure cap of FIG. 5.

In FIGS. 5 and 6, the bottom 22 of the disc-like sealing member 3 is spaced slightly above the upper edge 23 of the cylindrical part 2, so that upper edge 24 of the bottleneck protrudes beyond the upper edge 23 of the cylindrical part 2. Consequently, when screwing off the closure cap to open the bottle, liquid may flow out of the bottleneck directly, without contacting the upper edge 23 of the cylindrical part 2. The small bearing brackets 5' and 6' which support bar 7 are made correspondingly high.

Figure 7:
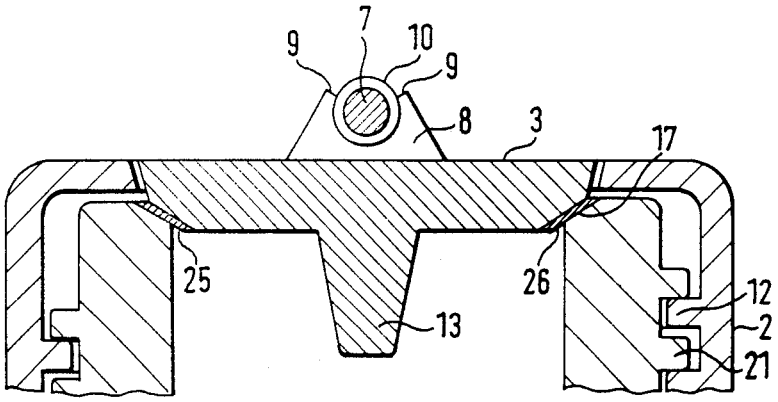
FIG. 7 is a cross-sectional view of a modification of the embodiment according to FIG. 4.

FIG. 7 substantially corresponds to the upper part of FIG. 4 except notch 15 and O-ring 16 are eliminated. Instead, the disc-like sealing member 3 is provided with a conical annular sealing surface 25, coated with a flexible layer 26 of plastic material, which bears against the complementary conical sealing surface 17 of the bottleneck 1. In this embodiment, the disc-like sealing member 3 is thinner than the one in FIG. 4.

Figure 8:
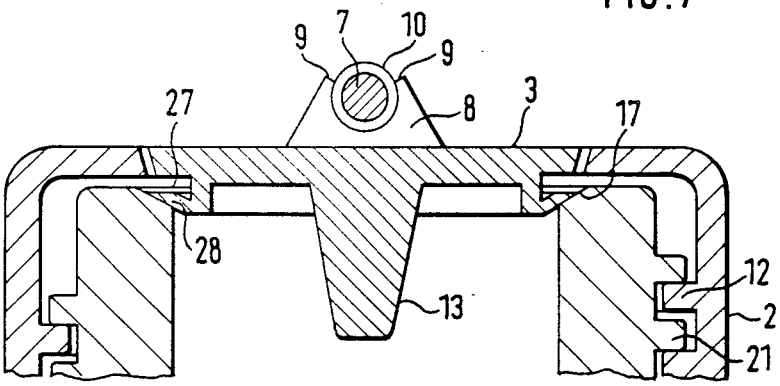
FIG. 8 is a view like FIG. 7 showing another modification of the closure cap according to FIG. 4.

In FIG. 8 the conical sealing surface 25 of FIG. 7 is provided with a circumferential undercut 27 to provide a flexible sealing lip 28 to compensate for manufacturing tolerances in the conical sealing surface 17 of the bottleneck 1 or in the disc-like sealing member 3.

Figure 9:
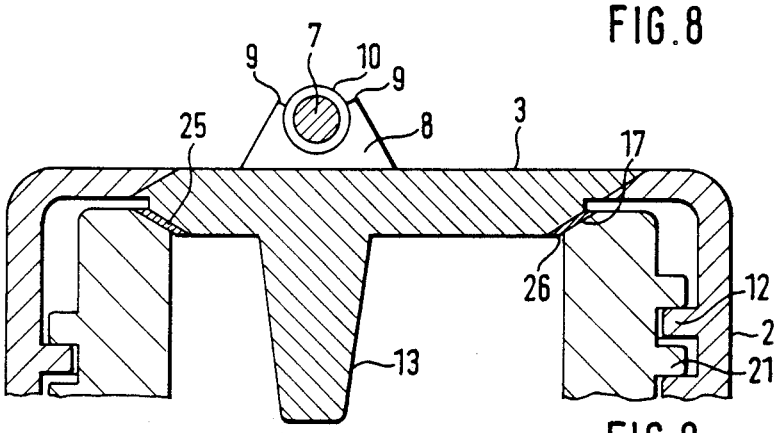
FIG. 9 is a view like FIG. 7 showing another embodiment of the screw-type closure cap according to the invention.

In FIG. 9, the bar 7 serving as rotational axis for the sealing member 3, is offset from the axis of the cylindrical part 2 so that the right side of the disc-like sealing member 3 shown in FIG. 9 allows a larger out flow cross-section.

Figure 10:
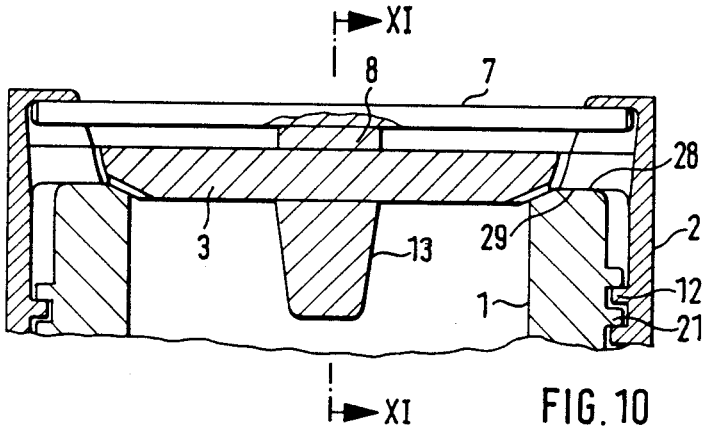
FIG. 10 is a vertical cross-sectional view of another embodiment in form of a relief valve.
Figure 11:
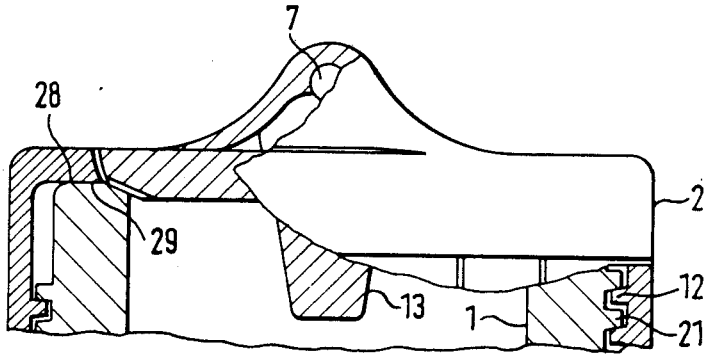
FIG. 11 is a cross-sectional view taken along the line XI—XI of FIG. 10.

FIGS. 10 and 11 show the section of a further embodiment similar to FIG. 3. It differs from FIG. 3, in that one small bearing bracket 8 is used in the central area, rather than two. The bar or shaft 7 bends upwards and serves as a spring to bias the sealing member toward the bottleneck. Sealing member 3 connected to the shaft 7 through the bracket, moves away from the upper end 29 of the bottleneck 1, so that pressure may escape.

In order to achieve a defined position of bar 7 and, thus, a defined, pretension, the cylindrical part 2 is equipped with an inturned flange 30, the underside of which defines the axial position of the cylindrical part 2 in relation to the upper edge 29 of the bottleneck 1.

By this defined pre-tension it is possible to exactly adjust the pressure at which the sealing member is lifted from the top edge 29 of the bottle by pressurized liquid in the bottle against the force of the spring, i.e., bar 7, and thus an excess pressure is released. This helps avoiding excess pressure in the bottle, which may lead to an explosion and, thus, also to accidents.

I claim:

1. A cylindrical screw-on closure cap for a container having an externally-threaded neck and an internal seat in the top of said neck, a separate unitary sealing member, rotatably connected to the top of the cylindrical part of said cap, having an annular sealing surface which fits onto said seat and seals said container when said cap is screwed tightly onto said neck in closed position, said sealing member being rotatably mounted on an axis located in a plane perpendicular to the axis of said neck, whereby said sealing member can tilt about said rotational axis when said closure cap is loosened to open position.

2. A closure cap according to claim 1, wherein said sealing member is disc-shaped.

3. A closure cap according to claim 1, wherein the rotational axis of said sealing member intersects the axis of the cylindrical part of said cap.

4. A closure cap according to claim 2, wherein the rotational axis of the disc-shaped sealing member is offset from the axis of the cylindrical part of said cap.

5. A closure cap according to claim 2, wherein said rotational axis is located above the side of said sealing member opposite the sealing side of said sealing member.

6. A closure cap according to claim 2 which includes an inwardly directed flange projecting from the inner wall of said cylindrical part on which flange the disc-shaped sealing member lies when in closed position, said sealing member being freely rotatable about a bar concentric with said rotatable axis.

7. A closure cap according to claim 2 which includes a pair of spaced bearing brackets projecting upwardly from said cylindrical part toward said rotational axis, and the bottom of said sealing member is spaced above the top of said cylindrical part.

8. A closure cap according to claim 2 wherein said sealing member has a pin projecting from the bottom thereof to limit the inclination of said sealing member by abutting the inner wall of said container neck when said closure cap is in open position.

9. A closure cap according to claim 1, wherein said sealing member and said cap are molded from plastic, and said rotational axis consists of a bar integrally molded with said cap, and said sealing member has at least one C-shaped bearing bracket, the arms of the C embracing said bar.

10. A closure cap according to claim 9, wherein said sealing member has two spaced bearing brackets, and said bar has a pair of circumferential flanges which abut the inner sides of said brackets with slight clearance.

11. A closure cap according to claim 9 in which said sealing member has a groove in its peripheral edge and an O-ring disposed in said groove.

12. A closure cap according to claim 9 wherein the inner surface of said cylindrical part has a circular bead which abuts against the exterior wall of said bottleneck near the lower end of said cylindrical part.

13. A closure cap according to claim 1, wherein said sealing member is connected to said cylindrical part of said cap by a means which biases said sealing member against said internal seat to provide a relief valve which opens when the internal pressure in the container exceeds the biasing force.

14. A closure cap according to claim 9, wherein said sealing member has a conical peripheral surface to provide a ring-shaped seal.

15. A closure cap according to claim 14, wherein said conical surface is part of a flexible sealing lip.

16. A closure cap according to claim 13, wherein the biasing means is a flexible bar, coincident with the rotational axis of the sealing member, the ends of which are fixed to said cylindrical part and which is connected to said sealing member by a bearing bracket projecting from the side of the sealing member opposite the sealing side.

17. A closure cap according to claim 13, wherein said cylindrical part is provided at the top with an inturned flange, the underside of which defines the axial position of said cap in relation to the upper edge of said neck.

* * * * *